United States Patent [19]

Verheyen

[11] Patent Number: 4,726,333

[45] Date of Patent: Feb. 23, 1988

[54] GLOW PLUG ALTERNATOR CONTROL

[75] Inventor: Michael R. Verheyen, Peoria, Ill.

[73] Assignee: Caterpillar Inc., Peoria, Ill.

[21] Appl. No.: 935,897

[22] Filed: Nov. 28, 1986

[51] Int. Cl.[4] ..... F02P 19/02

[52] U.S. Cl. ..... 123/145 A; 123/179 H

[58] Field of Search ..... 123/145 A, 179 H, 179 BG, 123/179 B; 219/497, 504, 505

[56] References Cited

U.S. PATENT DOCUMENTS

| | | | |
|---|---|---|---|
| 4,307,688 | 12/1981 | Steele | 123/179 BG |
| 4,322,604 | 3/1982 | Kawamura et al. | 123/145 A |
| 4,337,389 | 6/1982 | Ball | 219/511 |
| 4,377,138 | 3/1983 | Mitani et al. | 123/145 A |
| 4,478,181 | 10/1984 | Kikuchi et al. | 123/145 A |
| 4,552,102 | 11/1985 | Egle | 123/145 A |
| 4,594,975 | 6/1986 | Shigenobu | 123/145 A |

*Primary Examiner*—Andrew M. Dolinar

*Attorney, Agent, or Firm*—Robert E. Muir

[57] ABSTRACT

The present invention pertains to a control system for igniting devices used in an internal combustion engine. In order to ignite alcohol fuel in a diesel engine, the fuel must be heated before or during compression. Glow plugs conveniently provide heat, but have a short life in such continuous applications. Glow plugs must be accurately controlled to prevent overheating, which leads to open-circuiting. Individual constant voltage controls attempt to provide this function, but are only moderately successful. They are costly and complex, and provide only moderate protection from overheating. Since glow plug resistance correlates to glow plug temperature, resistance control provides better protection against glow plug overheating. Therefore, an apparatus monitors the resistance of a single glow plug, and controls the resistance of each glow plug to a preselected resistance value. This preselected resistance value represents a glow plug temperature, that provides satisfactory fuel combustion combined with improved glow plug life. The principal use of the apparatus of the present invention is with internal combustion engines using alternate fuels.

24 Claims, 4 Drawing Figures

THRESHOLD RESISTANCE
78
COMPARATOR
81
PRESELECTED RESISTANCE
50
COMPARATOR
48
PRESELECTED VOLTAGE
68
COMPARATOR
66
84
82
86
DIVIDER
46
52
OUTPUT MEANS
I→V CONVERTOR
60
CURRENT SENSOR
40
VOLTAGE SENSOR
44
+26
-
CONTROLLING SIGNAL
IGP
VGP

IOUT
IIN
62
103
67
110
83
80
76
72
74
70
112
104
102
108
106
47
65
100
64
+15V
FEED-BACK
V
90
92
94
96
98
101

GLOW PLUG ALTERNATOR CONTROL

TECHNICAL FIELD

This invention relates generally to an apparatus for controlling igniting devices of an internal combustion engine and more particularly to an apparatus for continually regulating the resistance of glow plugs over the temperature range of an operating engine.

BACKGROUND ART

In todays world of dwindling and unsteady petroleum supplies, many human resources are devoted to the selection and refinement of alternate fuels. Furthermore, many "third world" countries that cannot afford high priced foreign petroleum are forced to use various types of domestic fuel. However, the use of most alternate fuels causes the malfunction of traditional engines and the deterioration of their components.

Recently, new polymers have substantially cured the latter problem, leaving the functional problem as the greatest challenge to overcome. This problem manifests itself in inefficient combustion. Ignition of some of these fuels requires a catalyst. Diesel engines, for instance, must provide heat, in addition to compression, to ignite the alternate fuel.

Glow plugs assist combustion in alcohol fueled engines. Unfortunately, energizing a glow plug in the continuously changing temperature of an operating engine poses additional problems. Glow plugs are utilized primarily for starting engines and can be damaged quite easily if used over longer periods of time.

Precision voltage controls attempt to prolong glow plug life. These controls maintain a constant glow plug voltage. As the engine heats, the glow plug remains driven by the constant voltage. Soon cylinder temperature exceeds the temperature required for combustion. Therefore, the glow plugs waste energy and glow plug life shortens.

Additionally, in many systems, each glow plug requires a seperate control to step down the vehicle electrical system voltage to levels which provide satisfactory fuel combustion and adequate glow plug life. A control scheme of this type wastes money and is unnecessarily complex. For example, a six cylinder engine requires six controls.

The present invention is directed to overcoming one or more of the problems as set forth above.

DISCLOSURE OF THE INVENTION

In accordance with one aspect of the present invention an apparatus controls the resistance of a glow plug over various operating temperatures in an engine. The resistance of the glow plug is determined and compared to a preselected glow plug resistance. A resistance error signal is delivered in response to a difference between the compared signals. The resistance error signal is received by a circuit which delivers a signal to the glow plug to control its resistance relative to the preselected glow plug resistance.

In accordance with another aspect of the present invention an apparatus controls the resistance of a plurality of glow plugs over various operating temperatures in an engine. The current through one of the glow plugs is sensed and a signal relative to the magnitude of the sensed current is delivered. The voltage across the glow plug is sensed and a signal relative to the magnitude of the sensed voltage is delivered. The sensed voltage signal is divided by the sensed current signal to obtain a glow plug resistance, and a signal relative to the magnitude of the obtained resistance is delivered. A signal relative to the magnitude of a preselected glow plug resistance is compared to the obtained resistance signal, and a resistance error signal is delivered in response to a difference between the compared resistance signals. The resistance error signal is received, and an alternator input signal is delivered in response to the resistance error signal. A resistance controlling signal is delivered to the plurality of glow plugs in response to the alternator input signal. The resistance of the plurality of glow plugs is controlled relative to the preselected resistance.

Alternate fuels, such as alcohol, are becoming commonplace in many areas of the world. In order to burn alcohol fuel in a diesel engine, additional heat must be supplied, usually from the glow plugs already present in the engine. Since glow plugs are not designed for prolonged use, they typically fail within a short period of time. Precision voltage controls attempt to regulate the glow plugs during operation to lengthen their usable lives. As the engine operates and its temperature changes, the voltage controls tend to overdrive the glow plugs and the glow plugs overheat. Therefore, while these controls do prolong glow plug life, additional operating life can still be coaxed from a glow plug.

As a solution to this problem, the present invention regulates the glow plug power output in response to temperature changes in the cylinders of the engine. It has been observed that glow plug temperature varies with glow plug resistance. Therefore, glow plug resistance is monitored as an indication of temperature. By controlling the resistance of the glow plugs, their functioning temperature is controlled. Longer life results in response the glow plugs being protected from overheating.

Another advantage of the present invention is the reduction of complexity and cost. The present invention monitors one glow plug and controls all of them. The apparatus monitors only one glow plug, since there is little variation between glow plug parameters in an operating engine. This scheme eliminates the waste of duplicate controls for each glow plug.

BEST MODE FOR CARRYING OUT THE INVENTION

Figure 1:
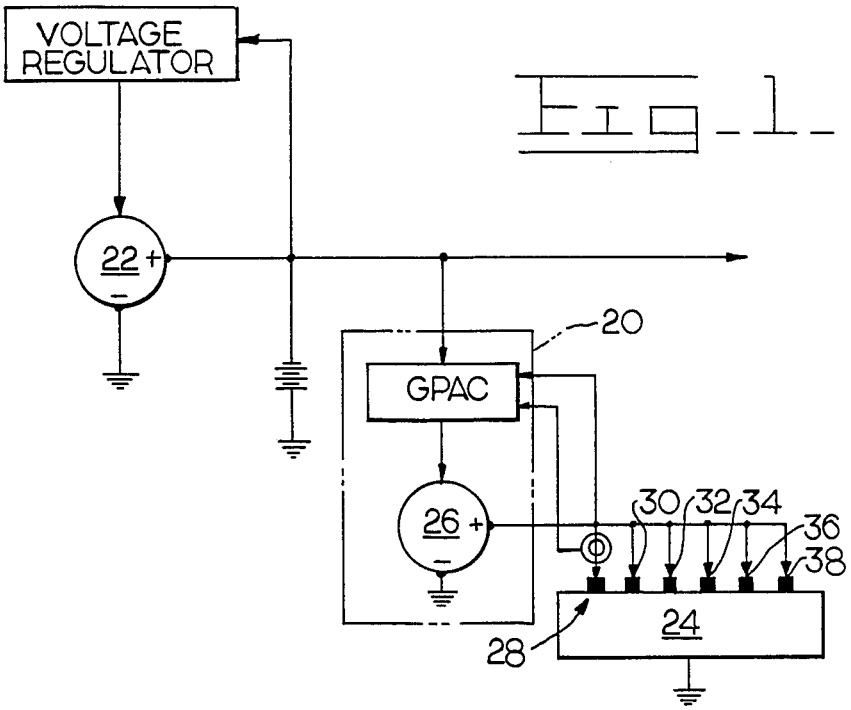
FIG. 1 illustrates the connection of the present invention to a typical vehicle electrical system.

FIG. 1 illustrates the system connection scheme of the glow plug alternator control apparatus 20. Power is provided to the apparatus 20 from a first alternator, the system alternator 22. The apparatus 20 senses the voltage and current through the glow plug 28 of the engine 24. The apparatus 20 determines the resistance of the glow plug 28 and compares it to a preselected resistance. A resistance error signal is delivered in response to a difference between the compared signals. The second alternator 26 is responsive to the resistance error signal and delivers a voltage signal to the glow plug 28 to control its resistance to the preselected resistance value. In addition, since the glow plugs 30,32,34,36,38 are connected in parallel with the glow plug 28, all of the glow plugs 30,32,34,36,38 are controlled to the preselected resistance.

Figure 2:
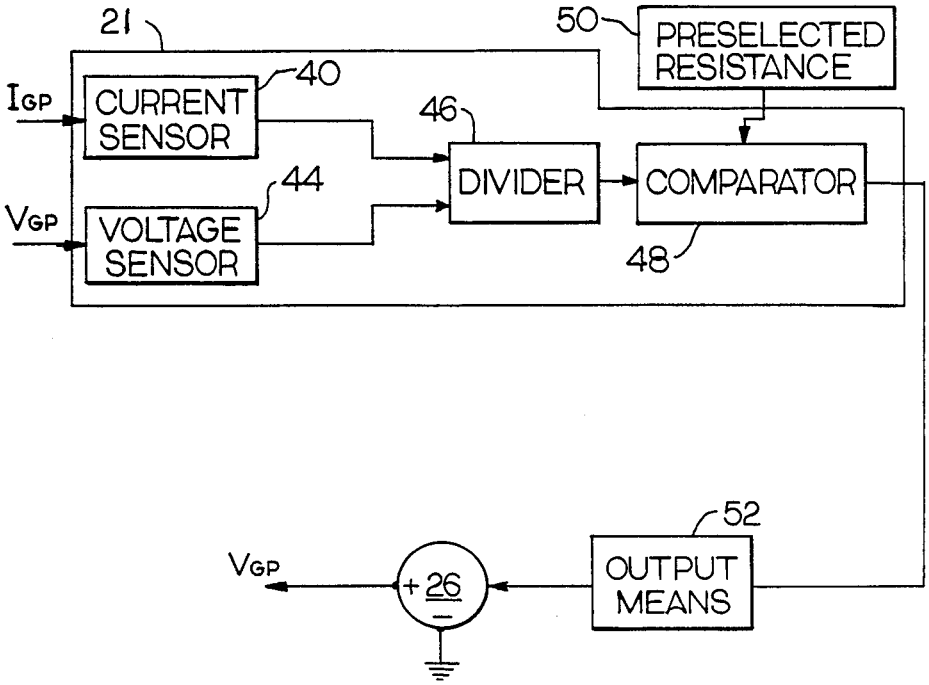
FIG. 2 illustrates a functional block diagram of a preferred embodiment of the present invention.

Refer now to FIG. 2 which illustrates a diagrammatic break down of the functions performed by the apparatus 20. A means 21 determines the resistance of a glow plug 28 in the following manner. A current sensor 40 senses the glow plug 28 current and delivers a signal relative to the magnitude of the sensed current. A voltage sensor 44 senses the glow plug 28 voltage and delivers a signal relative to the magnitude of the sensed voltage. These two signals are input to a divider means 46, where the sensed voltage signal is divided by the sensed current signal and a glow plug resistance is obtained.

The means 21 also delivers a resistance error signal in the following manner. A comparator 48 receives the obtained resistance signal and compares it to a preselected resistance signal delivered by a signal delivering means 50. The comparator 48 delivers a resistance error signal in response to a difference between the obtained resistance signal and the preselected resistance signal. An output means 52 receives the resistance error signal and delivers an alternator input signal in response thereto. A second alternator means 26 is responsive to the input signal. The second alternator means 26 delivers a resistance controlling signal to the plurality of glow plugs. The signal controls the resistance of each glow plug relative to the preselected glow plug resistance.

The voltage and current of one of a plurality of glow plugs is monitored. The voltage is divided by the current to obtain an indication of the glow plug's resistance. This value is compared with a preselected glow plug resistance, that is the desirable resistance of the glow plug. If the obtained resistance differs from the preselected resistance, the glow plug resistance is increased or decreased until it substantially equals the preselected resistance. As mentioned earlier in this specification, glow plug resistance is related to glow plug temperature. An operating engine cycles through a range of temperatures, so the temperature of the glow plugs changes. The apparatus 20 continuously monitors the resistance of a glow plug and controls the resistance of the plurality of glow plugs to protect them from overheating. Due to this substantially continuous resistance feedback, the glow plug resistance is prevented from drifting undesireably from the preselected resistance. The resistance control range is plus or minus five percent of said preselected glow plug resistance signal value.

Figure 3:
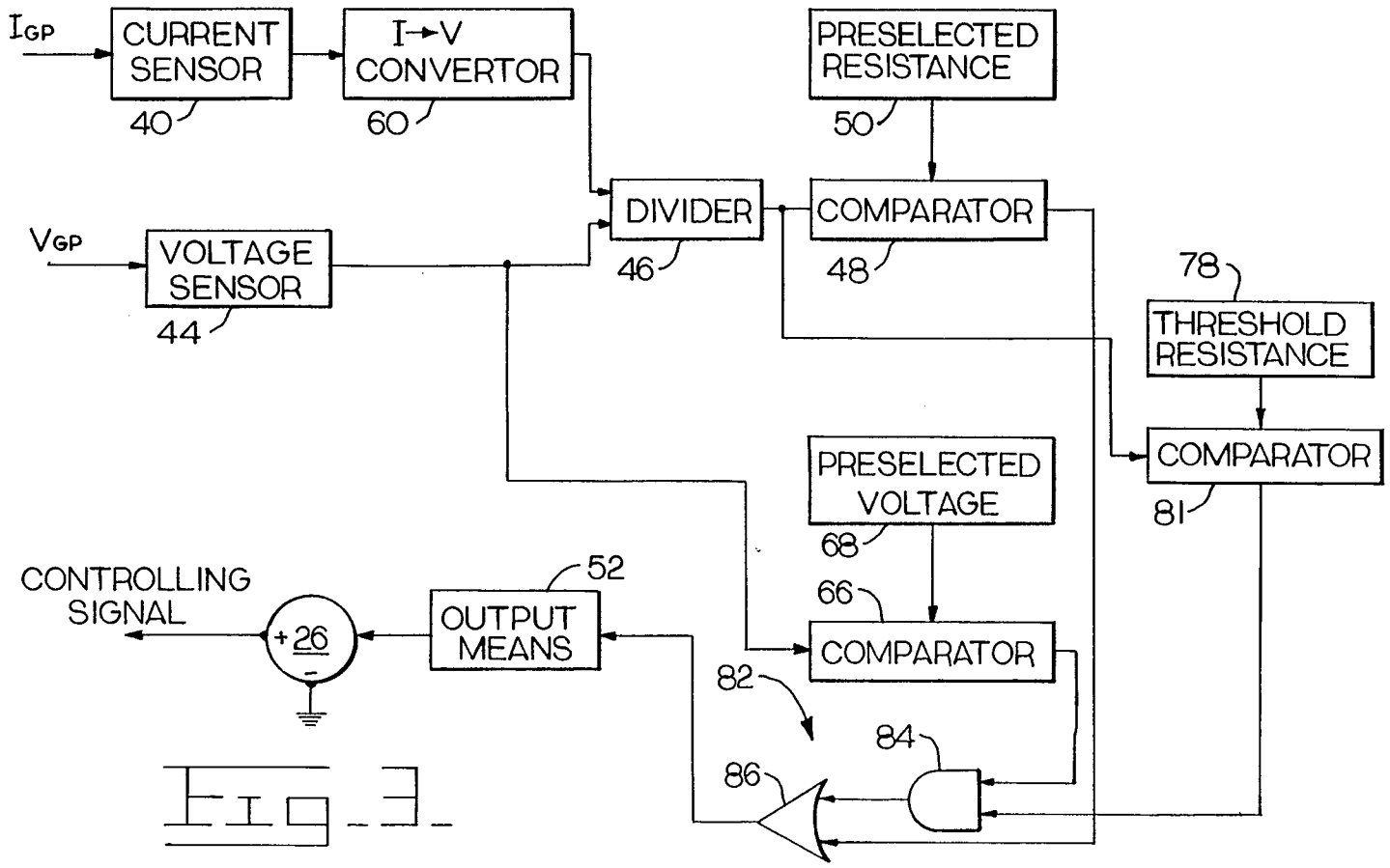
FIG. 3 illustrates a functional block diagram of the preferred embodiment of the present invention coupled with a constant voltage control for glow plugs.
Figure 4:
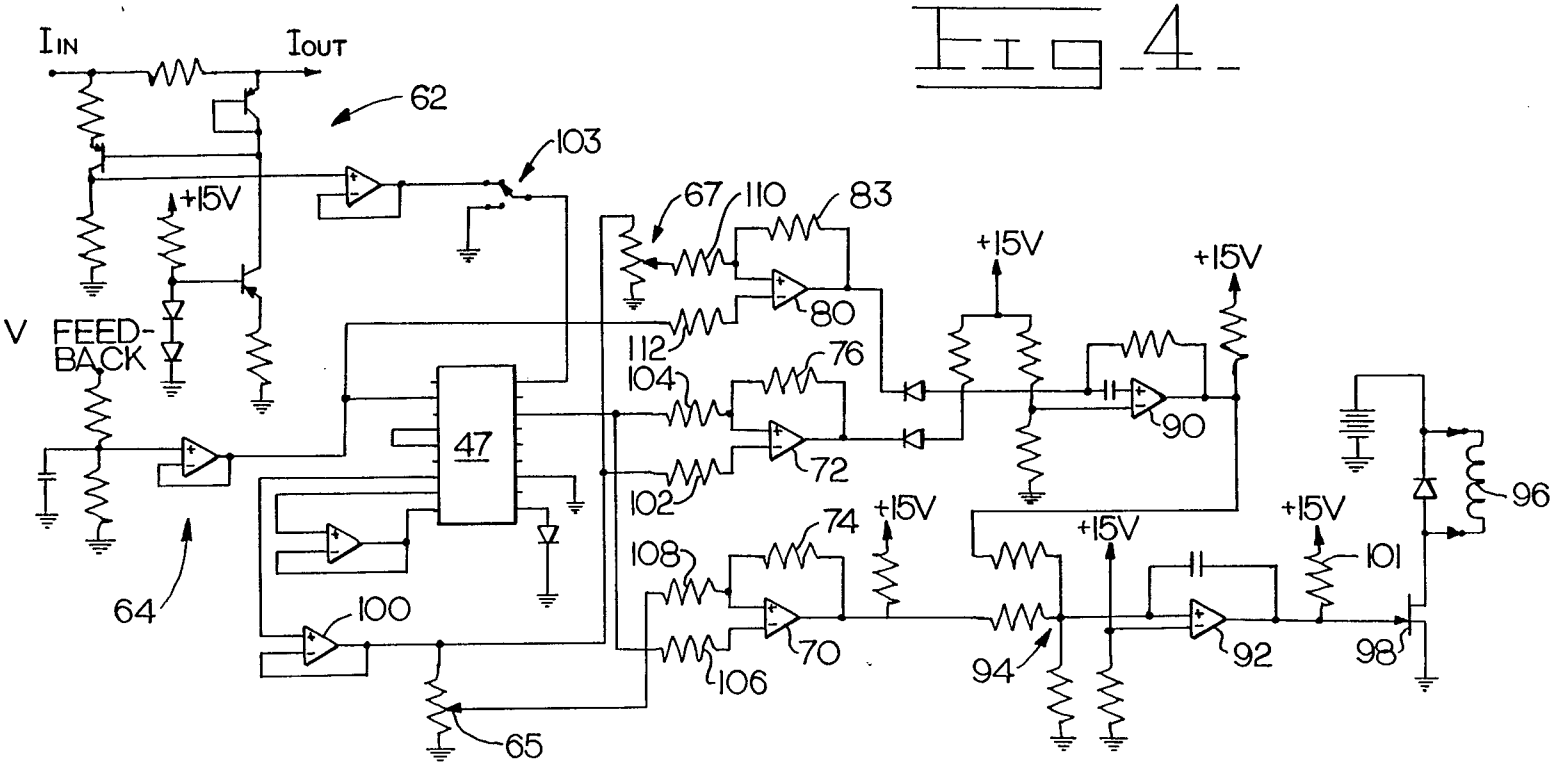
FIG. 4 illustrates a schematic of the preferred embodiment of FIG. 3.

Referring to FIGS. 3 and 4 which show another preferred embodiment of the apparatus 20. FIG. 3 illustrates a block diagram of the constant resistance control of FIG. 2, coupled with a constant voltage control. This type of control is desirable in the event of a glow plug failure. Should the monitored glow plug open-circuit, the control switches to a constant voltage type control until the failed glow plug is replaced. FIG. 4 depicts a detailed embodiment of the apparatus 20 of this invention.

A current sensor 40 senses the glow plug 28 current. A means 60 converts the sensed current to a voltage and delivers a signal relative to the magnitude of the sensed current. A current mirror circuit 62, as is well-known in the art, accomplishes these tasks. A voltage sensor 44 senses the glow plug 28 voltage and delivers a signal relative to the magnitude of the sensed voltage. The voltage sensor 44 is shown to be a simple buffered voltage divider circuit 64. The two signals are input to a divider means 46, such as the "AD538" 47 manufactured by Analog Devices of Norwood, Massachussetts. Here the sensed voltage signal is divided by the sensed current signal to obtain a glow plug resistance.

A comparator 48 compares the obtained resistance signal to a preselected resistance signal delivered by a signal delivering means 50, such as a potentiometer 65. The comparator 48 delivers a resistance error signal in response to the obtained glow plug resistance signal being less than the preselected glow plug resistance signal. A comparator 66 compares the sensed glow plug voltage signal to a preselected voltage signal delivered by a signal delivering means 68, also shown to be a potentiometer 67. The comparator 66 delivers a voltage error signal in response to a difference between the sensed and the preselected glow plug voltages. The comparator 66 delivers a voltage error signal in response to the sensed glow plug voltage being less than the preselected glow plug voltage. The resistance comparator 48 and the voltage comparator 66, shown in FIG. 3, are operational amplifiers 70, 80 with stability provided by respective feedback resistors 74, 83, as shown in FIG. 4. The operational amplifier 70 receives the preselected reistance signal from the potentiometer 65 via a resistor 106 and the obtained glow plug resistance from the divider 47 via a resistor 108. The operational amplifier 80 receives the preselected voltage signal from the potentiometer 67 via a resistor 110 and the sensed glow plug voltage signal from the buffered voltage divider circuit 64 via a resistor 112.

A detection circuit determines if a glow plug is open-circuited. A signal delivering means 78, such as an operational amplifier 100, delivers a preselected threshold resistance signal which is relative to the magnitude of a resistance value in the range of less than that of an open-circuited glow plug and greater than the preselected glow plug resistance. As shown in FIG. 4, an operational amplifier 72 is used as a comparator 81, which is shown in FIG. 3. This operational amplifier 72 receives the threshold resistance signal from the operational amplifier 100 via a resistor 102 and the glow plug resistance signal from the divider 47 via a resistor 104. The operational amplifier 72 delivers a 'high' voltage signal in response to the obtained glow plug resistance signal being greater than the preselected threshold resistance signal.

A logic means 82 selects one of the resistance error signal and the voltage error signal in response to the obtained glow plug resistance being respectively less than and greater than the preselected threshold resistance signal, and delivers the selected signal. As shown logically in FIG. 3, an 'AND' gate 84 receives the outputs of the glow plug voltage comparator 66 and the threshold resistance comparator 81. When the glow plug is open-circuited, the 'AND' gate 84 is enabled to deliver the voltage error signal. Furthermore, if the glow plug is open-circuited, the output of the resistance comparator 48 is 'low' since the obtained resistance is greater than the preselected resistance. The outputs of the 'AND' gate 84 and of the resistance comparator 48 are input to an 'OR' gate 86. The 'OR' gate 86 delivers a 'high' signal if any of its inputs are 'high'. Therefore, when the glow plug 28 is operational, the 'AND' gate 84 cannot deliver a 'high' signal, and the resistance error signal is selected. When the glow plug 28 open-circuits, the resistance comparator 48 cannot deliver a 'high' signal, and the voltage error signal is selected. The logic means 82 also includes a switch 103 for selecting said voltage error signal in response to closure of said switch.

In FIG. 4, the logic means 82 includes amplifiers 90, 92 adapted for selecting one of the resistance error signal and the voltage error signal in response to the obtained glow plug resistance being respectively less than and greater than the preselected threshold resistance, and delivering the selected signal. The operational amplifier 90 receives output signals from the operational amplifiers 72, 80 and outputs a 'high' signal only if both signals are 'high'. The output signals from the amplifier 90 and the amplifier 70 are input, using a wired 'OR' connection 94 as is well known in the art, to the amplifier 92. The amplifier 92 outputs a 'high' voltage signal if either of the input signals is 'high'. The function of this logic, as described in the previous paragraph, is to select the resistance error signal, when the glow plug 28 is not open-circuited, and to select the voltage error signal, when the glow plug 28 is open-circuited.

An output means 52 receives the selected signal. This signal is converted to a higher powered signal and sent to the input of the second alternator means 26. The second alternator 26 receives the input signal. The input signal is pulse width modulated. This is because a 'high' voltage signal results from a resistance or voltage which is less than the respective preselected value, and a 'low' voltage signal results from a resistance or voltage signal which is equal to or greater than the respective preselected value. Upon reception of a 'high' input signal, the current in the alternator field winding 96 increases. This leads to an increase of the alternator's output voltage. If the resistance error signal is selected, the output voltage controls the resistance of the plurality of glow plugs 28,30,32,34,36,38 to the preselected resistance. If the voltage error signal is selected, the output voltage controls the voltage of the plurality of glow plugs 28,30,32,34,36,38 to the preselected voltage.

The output means 52 is shown in FIG. 4 as a field effect transistor 98 with a pull-up resistor 101 connecting the gate of the transistor 98 to a positive voltage source. The gate of transistor 98 receives the selected signal from the output of the operational amplifier 92. When the gate voltage is positive, the transistor turns 'on' and conducts current from the positive voltage source through the alternator winding 96 to circuit ground. When the gate voltage is zero, the transistor turns 'off' and does not conduct current. Controlling the current in the alternator field winding 96 controls the second alternator's 26 output voltage, which is delivered to the glow plugs 28,30,32,34,36,38. In this way, power is supplied to the alternator field winding for transfer to the plurality of glow plugs 28,30,32,34,36,38 for controlling their resistance and temperature.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

Industrial Applicability

Assume that a six cylinder alcohol fueled diesel engine is equipped with the glow plug alternator control of this invention. As mentioned earlier in this specification, glow plug resistance varies linearly with glow plug temperature. Also, overheating constitutes a primary cause of glow plug failure. Before the engine can be started, the glow plugs must heat to a temperature sufficiently high to initiate combustion of the fuel. This temperature corresponds to the preselected resistance value. This is a value calculated to give optimum glow plug life, while providing satisfactory fuel combustion. After the glow plugs reach this preselected temperature, the engine is started.

Soon the friction of the pistons in the cylinders, in combination with many other factors, raises the temperature inside the cylinders. In a constant voltage type control, the cylinder heat increases the glow plug temperature. As the temperature increases the resistance increases, so the glow plug disapates more power. However, in the glow plug alternator control, the resistance of the glow plugs is controlled. This has the effect of controlling the temperature of the glow plugs. Each glow plug resistance is controlled to the preselected resistance and are maintained substantially at the magnitude of the preselected resistance.

At start-up the engine is cold, so the measured glow plug resistance is less than the preselected glow plug resistance. Therefore, the comparing means outputs a 'high' logic voltage signal. This signal is sent to the output means, which adds power to the signal. The second alternator receives the high powered logic signal. The signal effects the field winding by increasing the current flowing through it, and the field winding current then increases the alternators output voltage. The glow plugs are connected in parallel with each other and with the alternator output. The glow plugs receive the alternator output voltage, which increases their resistance and temperature.

Soon the measured resistance exceeds the preselected resistance. This causes the comparator to output a 'low' logic voltage signal. The output means receives this signal and sends a low power logic signal to the alternator. This signal decreases the current in the field winding as well as the output voltage of the alternator. The 'low' output voltage decreases glow plug resistance and glow plug temperature.

The above described cycle controls the glow plug resistance and temperature within a small range about the preselected value.

Other aspects, objects, and advantages of this invention can be obtained from a study of the drawings, the disclosure, and the appended claims.

What is claimed:

1. An apparatus for controlling the resistance of a glow plug over various operating temperature ranges of an internal combustion engine, the apparatus being electrically powered by a first alternator, said apparatus comprising:

means for determining the resistance of the glow plug, comparing said glow plug resistance with a preselected glow plug resistance, and delivering a resistance error signal in response to a difference between said compared signals; and second alternator means for delivering a voltage signal to said glow plug and controlling said glow plug's resistance relative to the preselected resistance in response to receiving the resistance error signal.

2. The apparatus as set forth in claim 1, wherein the engine has a plurality of glow plugs, the resistance determining means determines the resistance of only one of the glow plugs, and the second alternator means controls the resistance of said plurality of glow plugs.

3. The apparatus as set forth in claim 1, wherein said means for determining resistance includes means for sensing current through said glow plug and delivering a signal relative to the magnitude of said sensed current.

4. The apparatus as set forth in claim 1, wherein said means for determining resistance includes means for sensing voltage across said glow plug and delivering a signal relative to the magnitude of said sensed voltage.

5. The apparatus as set forth in claim 1, wherein said means for determining resistance includes a divider.

6. An apparatus for controlling the resistance of a plurality of glow plugs over various operating temperature ranges of an internal combustion engine, the apparatus being electrically powered by a first alternator, said apparatus comprising:

means for sensing current through one of said glow plugs and delivering a signal relative to the magnitude of said sensed current;

means for sensing voltage across said one glow plug and delivering a signal relative to the magnitude of said sensed voltage;

means for dividing said sense voltage signal by said sense current signal, obtaining a glow plug resistance, and delivering a signal relative to the magnitude of said obtained glow plug resistance;

means for delivering a signal relative to the magnitude of a preselected glow plug resistance;

means for comparing said obtained glow plug resistance signal with said preselected glow plug resistance signal, and delivering a resistance error signal in response to a difference between said compared resistance signals;

output means for receiving the resistance error signal and delivering an alternator input signal in response to said resistance error signal; and second alternator means for only delivering electrical power to said glow plugs, receiving said alternator input signal, delivering a resistance controlling signal to said plurality of glow plugs in response to said alternator input signal, and controlling resistance of said glow plugs to said preselected glow plug resistance.

7. The apparatus as set forth in claim 6, wherein said current sensing means includes a current to voltage converter.

8. The apparatus as set forth in claim 6, wherein said comparator means outputs a signal in response to said obtained glow plug resistance signal being less than said preselected glow plug resistance signal.

9. The apparatus as set forth in claim 6, wherein said second alternator means includes an alternator field winding for receiving said second alternator input signal and altering output voltage of said second alternator.

10. The apparatus as set forth in claim 9, wherein said alternator input signal alters the current in said alternator field winding.

11. The apparatus as set forth in claim 6, wherein said resistance controlling signal maintains resistance of said glow plugs within a range about said preselected glow plug resistance.

12. The apparatus as set forth in claim 6, wherein said resistance control range is plus or minus five percent of said preselected glow plug resistance signal value.

13. The apparatus as set forth in claim 6, wherein said resistance controlling signal is a pulse width modulated voltage signal.

14. The apparatus as set forth in claim 6, wherein said resistance of said glow plugs increases in the presence of said resistance controlling signal and decreases in the absence of said resistance controlling signal.

15. An apparatus for controlling the resistance of a plurality of glow plugs over various operating temperature ranges of an internal combustion engine:

means for sensing current through one of said glow plugs;

means for converting said sensed current to a voltage and delivering a signal relative to the magnitude of said sensed current;

means for sensing voltage across said glow plug and delivering a signal relative to the magnitude of said sensed voltage;

means for dividing said sensed voltage signal by said sensed current signal, obtaining a glow plug resistance, and delivering a signal relative to the magnitude of said obtained glow plug resistance;

means for delivering a signal relative to the magnitude of a preselected glow plug resistance;

means for comparing said obtained and said preselected glow plug resistance signals, and delivering a resistance error signal in response to said obtained glow plug resistance signal being less than said preselected glow plug resistance signal;

means for delivering a signal relative to the magnitude of a preselected glow plug voltage;

means for comparing said sensed and said preselected glow plug voltage signals, and delivering a voltage error signal in response to a difference between said compared voltage signals;

means for delivering a preselected threshold resistance signal relative to the magnitude of a resistance value in the range of less than that of an open-circuited glow plug and greater than said preselected glow plug resistance;

logic means for selecting one of the resistance error signal and the voltage error signal in response to said obtained glow plug resistance being respectively less than and greater than the preselected threshold resistance signal, and delivering the selected signal;

output means for receiving the selected signal and delivering an alternator input signal in response to the selected signal; and alternator means responsive to said alternator input signal for delivering one of a resistance controlling signal and a voltage controlling signal to said glow plugs in response to said selected signal being said resistance error signal and said voltage error signal, respectively.

16. The apparatus as set forth in claim 15, wherein said logic means includes a switch for selecting said voltage error signal in response to closure of said switch.

17. The apparatus as set forth in claim 15, wherein said logic means includes amplifiers adapted for selecting one of said resistance error signal and said voltage error signal in response to said obtained glow plug resistance being respectively less than and greater than said preselected threshold resistance, and delivering the selected signal.

18. The apparatus as set forth in claim 15, wherein said current sensing means includes a current mirror circuit.

19. The apparatus as set forth in claim 15, wherein said glow plug resistance increases in the presence of said resistance controlling signal and decreases in the absence of said resistance controlling signal.

20. The apparatus as set forth in claim 15, wherein said glow plug voltage comparator means delivers a signal in response to said measured glow plug voltage signal being less than said preselected glow plug voltage signal.

21. The apparatus as set forth in claim 15, wherein said voltage controlling signal controls glow plug voltage to said preselected glow plug voltage.

22. The apparatus as set forth in claim 15, wherein said alternator means includes a field winding.

23. The apparatus as set forth in claim 22, wherein said alternator input signal alters the current in the field winding.

24. The apparatus as set forth in claim 23, wherein the current in the field winding increases in response to said alternator input signal being 'high' and decreases in response to said alternator input signal being 'low'.

* * * * *